US009959956B2

(12) United States Patent
Clelland et al.

(10) Patent No.: US 9,959,956 B2
(45) Date of Patent: May 1, 2018

(54) MACHINE FOR PRODUCING TRANSPOSED CABLE

(71) Applicant: GENERAL CABLE SUPERCONDUCTORS LIMITED, Upper Riccarton (NZ)

(72) Inventors: Lachlan Cameron Clelland, Lower Hutt (NZ); Christopher William Bumby, Wellington (NZ); Rodney Alan Badcock, Lower Hutt (NZ)

(73) Assignee: GENERAL CABLE SUPERCONDUCTORS LIMITED, Upper Riccarton (NZ)

( * ) Notice: Subject to any disclaimer, the term of this patent is extended or adjusted under 35 U.S.C. 154(b) by 349 days.

(21) Appl. No.: 14/440,988

(22) PCT Filed: Nov. 6, 2013

(86) PCT No.: PCT/NZ2013/000198
§ 371 (c)(1),
(2) Date: May 6, 2015

(87) PCT Pub. No.: WO2014/073986
PCT Pub. Date: May 15, 2014

(65) Prior Publication Data

US 2015/0287504 A1 Oct. 8, 2015

(30) Foreign Application Priority Data

Nov. 6, 2012 (NZ) ..... 603437

(51) Int. Cl.
*H01B 13/02* (2006.01)
*B65H 49/32* (2006.01)
*H01B 12/02* (2006.01)

(52) U.S. Cl.
CPC ..... *H01B 13/0278* (2013.01); *B65H 49/32* (2013.01); *H01B 12/02* (2013.01); *B65H 2701/34* (2013.01)

(58) Field of Classification Search
CPC ..... H01B 12/02; H01B 13/0278; B65H 49/32
See application file for complete search history.

(56) References Cited

U.S. PATENT DOCUMENTS 7,788,893 B2 9/2010 Beck et al.
7,980,051 B2 7/2011 Beck et al.
(Continued)

FOREIGN PATENT DOCUMENTS

DE 2829719 1/1980
JP 62-056265 11/1987
(Continued)

OTHER PUBLICATIONS

PCT/NZ2013/000198, International Preliminary Report on Patentability, Mar. 2, 2015, pp. 1-7.

*Primary Examiner* — Shaun R Hurley
(74) *Attorney, Agent, or Firm* — Dann, Dorfman, Herrell and Skillman, P.C.

(57) ABSTRACT

A cable winding machine for winding transposed cable from multiple serpentine subconductors such as in particular Roebel cable from such 2G HTS tape, without damaging the tape through edge-wise bending, comprises a conductor supply stage carrying subconductor supply spools to move the supply spools about a machine axis and maintain the supply spools in a common orientation as the subconductors unwind and move through the machine in a machine direction, and a cable forming stage after the conductor supply stage in the machine direction, arranged to bring together the subconductors and at which the subconductors interleave to form the transposed cable.

21 Claims, 11 Drawing Sheets

(56) References Cited

U.S. PATENT DOCUMENTS

| | | | | |
|---|---|---|---|---|
| 8,156,637 | B2 * | 4/2012 | Beck | H01L 39/248<br>174/125.1 |
| 2003/0024818 | A1 * | 2/2003 | Albrecht | H01L 39/143<br>204/622 |
| 2009/0183486 | A1 | 7/2009 | Beck et al. | |

FOREIGN PATENT DOCUMENTS

| | | |
|---|---|---|
| JP | 04-073820 | 3/1992 |
| JP | 05-182538 | 7/1993 |
| JP | 2005-019323 | 1/2005 |

* cited by examiner

MACHINE FOR PRODUCING TRANSPOSED CABLE

BACKGROUND

The invention relates to a machine for forming transposed cable such as Roebel cable, with minimal bending of the conductor elements.

FIELD OF INVENTION

Applications of high $T_c$ superconductors (HTS), such as power transformers and high current magnets, often require high current capacity.

Increased current capacity can be attained by forming cables of multiple subconductors in which the individual conductors or subconductors are continuously transposed such that each subconductor is electromagnetically equivalent, so that current is equally shared and AC losses minimised. The Roebel bar and Rutherford cable are transposed conductor cable configurations of subconductors with rectangular cross-section.

U.S. Pat. Nos. 7,788,893 and 7,980,051 disclose machines and methods for winding in particular Roebel cable, from 2G HTS tape and without edge-wise bending which may damage the HTS tape ('second generation' or 2G HTS conductor is produced as a thin film of the HTS such as $YBa_2Cu_3O_7$ on a base metal tape substrate).

SUMMARY OF INVENTION

The invention provides an improved or at least alternative machine for winding in particular Roebel cable from such 2G HTS tape, without damaging the tape through edge-wise bending.

In broad terms in one aspect the invention comprises a cable winding machine for winding transposed cable from multiple serpentine subconductors, comprising:

a conductor supply stage carrying a subconductor supply spool for each subconductor and arranged to move the supply spools about a machine axis and maintain the supply spools in a common orientation as the multiple serpentine subconductors unwind from the supply spools and move through the machine in a machine direction, and a cable forming stage after the conductor supply stage in the machine direction, arranged to bring together the subconductors and at which the subconductors interleave to form the transposed cable.

In a preferred form the conductor supply stage is arranged to move the subconductors in a non-circular path about the machine axis, as the subconductors move through the machine in a machine direction and while holding the subconductors in the predetermined and common orientation.

In a preferred form the conductor supply stage each subconductor supply spools comprises an associated back-wind mechanism arranged to pay out the subconductor at a substantially constant tension and also rewind excess subconductor length back onto the spool when required during operation of the conductor supply stage.

In a preferred form the conductor supply stage comprises an endless conveyor such as a flexible conveyor such as a chain or belt-based conveyor. The conveyor (spool conveyor) may carry a subconductor supply spool for each subconductor.

The subconductors move through the machine with a longitudinal displacement between subconductors of L/n where L is a subconductor transposition length and n is the total number of subconductors wound in the cable. In a preferred form a spool conveyor carries a subconductor supply spool for each subconductor, and each subconductor unwinds from its supply spool with a displacement in the forward direction of L/n relative to the subconductor unwinding from the next prior spool on the spool conveyor and with a displacement in the forward direction of −L/n relative to the subconductor unwinding from the next subsequent spool on the spool conveyor. The supply spools are equidistantly spaced on the spool conveyor. Each supply spool completes one complete orbit of the machine axis for each subconductor length, L, drawn through the machine. The supply spools are maintained in a fixed orientation relative to ground and relative to one another as the spool conveyor moves, so that the subconductors are all held in a predetermined orientation relative to one another about their longitudinal axes as they are unwound from the supply spools and move through the machine i.e. so as not to rotate or twist about their longitudinal axes. The machine comprises as many subconductor supply spools as subconductors in the cable to be produced.

The individual subconductors may be tape subconductors i.e. each have a width dimension across a longitudinal axis greater than a depth dimension through the longitudinal axis perpendicular to the width direction, and holding the subconductors in the predetermined orientation may comprise holding the subconductors with the width dimension of all of the subconductors parallel as the subconductors move through the machine. The subconductors may comprise HTS subconductors and may comprise an HTS layer on a metal substrate i.e. comprise 2G HTS conductors.

In a preferred form the cable forming stage comprises guides on either side of the machine axis between which all of the subconductors are continuously brought together. The cable forming stage may also comprise after said guides, or comprise alternatively to said guides, opposed rollers about spaced axes across and on either side of the machine axis, followed by opposed rollers about spaced oppositely oriented axes again on either side of the machine axis.

In broad terms in another aspect the invention comprises a cable winding machine for winding transposed cable from multiple serpentine subconductors, comprising:

a conductor supply stage comprising an endless flexible conveyor carrying a subconductor supply spool for each subconductor and arranged to move the supply spools about a machine axis and maintain the supply spools in a predetermined and common orientation as the multiple serpentine subconductors unwind from the supply spools and move through the machine in a machine direction, and a cable forming stage after the conductor supply stage in the machine direction, arranged to bring together the subconductors and at which the subconductors interleave to form the transposed cable.

The spool conveyor may follow a non-circular path. The spool conveyor may be a flexible conveyor such as a chain or belt-based conveyor.

By "serpentine" in this specification in relation to the subconductors is meant subconductors comprising a first series of element portions having a generally common longitudinal axis and a second series of element portions having a generally common longitudinal axis that is spaced from the longitudinal axis of said first series of element portions in the plane of the substrate, with connecting portions between.

By "comprising" as used in this specification means "consisting at least in part of". When interpreting each statement in this specification and claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

BRIEF DESCRIPTION OF THE DRAWINGS

The invention is further described with reference to the accompanying drawings, in which.

DETAILED DESCRIPTION OF PREFERRED FORM

Figure 1:
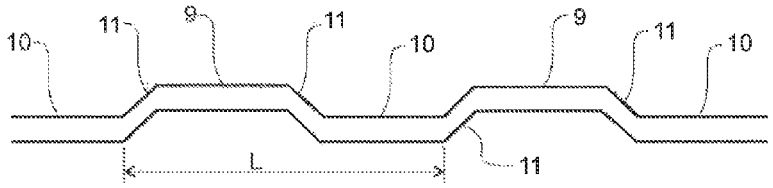
FIG. 1 shows a length of a serpentine tape subconductor.

FIG. 1 shows a length of serpentine subconductor. The subconductor comprises alternating relatively long parallel straight portions or sections 9 and 10 connected by shorter angled transition or connecting portions or sections 11. The relative size and shape of the straight sections and transition sections may vary dependent on the design of the cable to be produced. The cross-over sections 11 may have a sinuous shape (for example with the edges following a sinusoidal path) rather than the straight-sided transitions shown. However, for the same length of cross-over, more sinuous shapes will have a more constricted cross-section and are not favoured on account of the reduced local current carrying capacity. It is desirable to shape the subconductors so that there are both lateral and longitudinal spaces formed between the subconductors in the finished cable as shown in FIG. 2. The length L shown is the transposition length of the subconductor.

Figure 2A:
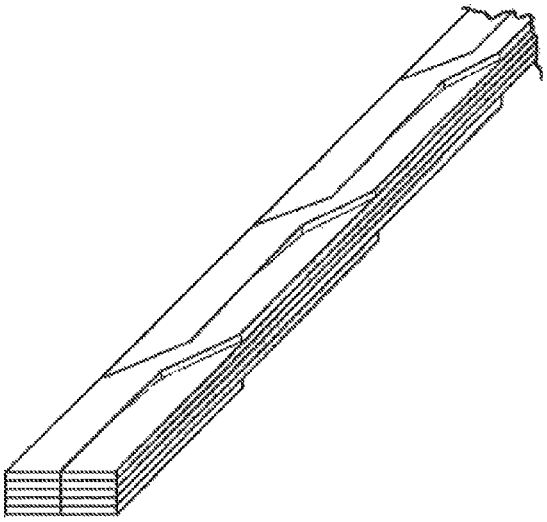
FIG. 2A shows a length of Roebel cable formed from ten tape subconductors and FIG. 2B shows a length of Roebel cable formed from three tape subconductors, in each case of the type shown in FIG. 1.
Figure 2B:
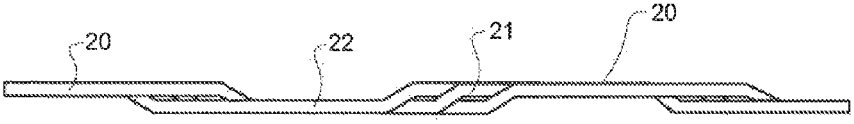

FIGS. 2A and 2B each show a short length of Roebel cable, consisting of ten and three wound tape subconductors of the type shown in FIG. 1 respectively. In FIG. 2B the three subconductors are indicated at 20, 21, and 22. In each case the subconductors are wound around each other along their entire length. The machine of the invention is for forming transposed cable of this type, from subconductors of the type shown in FIG. 1, and in which subconductors are transposed or wound around one another during manufacture with minimal stress on the subconductors. Typically the subconductors are tape-like subconductors as shown, comprising an HIS thin film on a metal substrate.

Figure 3:
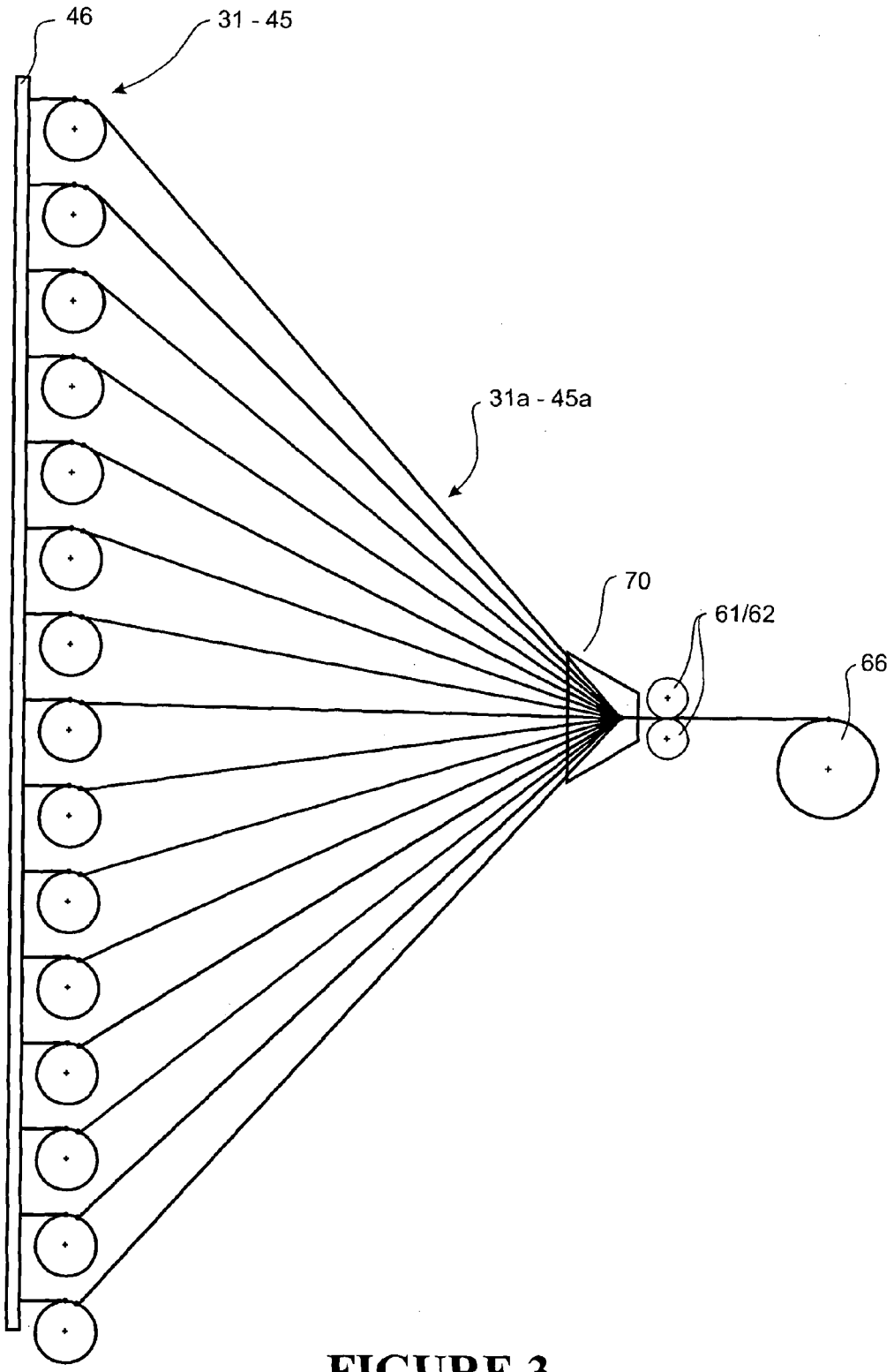
FIG. 3 is a schematic illustration of the cable winding method and machine of the invention.

FIG. 3 schematically illustrates an embodiment of the cable winding machine and method of the invention for forming cable from fifteen subconductors. A conductor supply stage CSS has fifteen supply spools 31-45 from each of which one of subconductors 31*a*-45*a* is unwound into a cable forming stage CFS, and which are all carried by a moving endless spool conveyor 46 which moves about a machine direction indicated by arrow MD, while maintaining the spools 31-45 in a fixed orientation relative to ground and relative to one another as the spool conveyor 46 circulates. The subconductors 31*a*-45*a* are unwound from the supply spools 31-45 and move forward through the machine at the same speed. All of the subconductors 31*a*-45*a* move through the machine in the machine direction and towards a central axis also referred to herein as the machine axis, at which all subconductors come together substantially simultaneously and are interleaved to form the cable at cable forming stage CFS. The cable forming stage CFS is positioned in the machine axis and the conductor supply stage CSS is positioned so that the geometric centre of the spool conveyor 46 is in the machine axis. The formed cable is subsequently taken up onto spool 66 at a rate which ensures that a length L (a transposition length as indicated in FIG. 1) of formed cable is drawn from the CFS for every full orbit about the machine axis of the supply spools 31-45.

Figure 4:
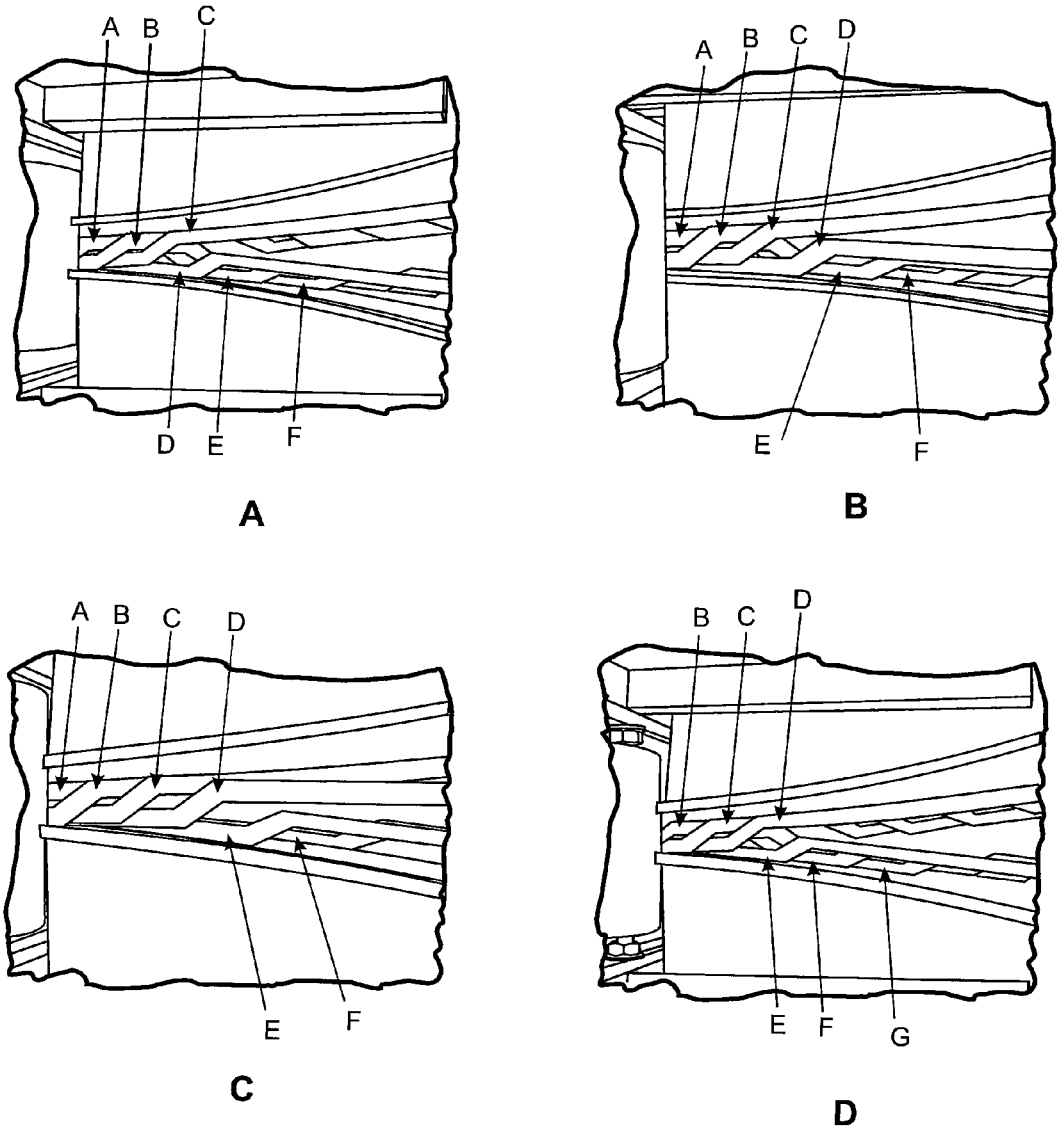
FIGS. 4A-D schematically illustrates incremental steps from 4A to 4D in the cable winding method.
Figure 5:
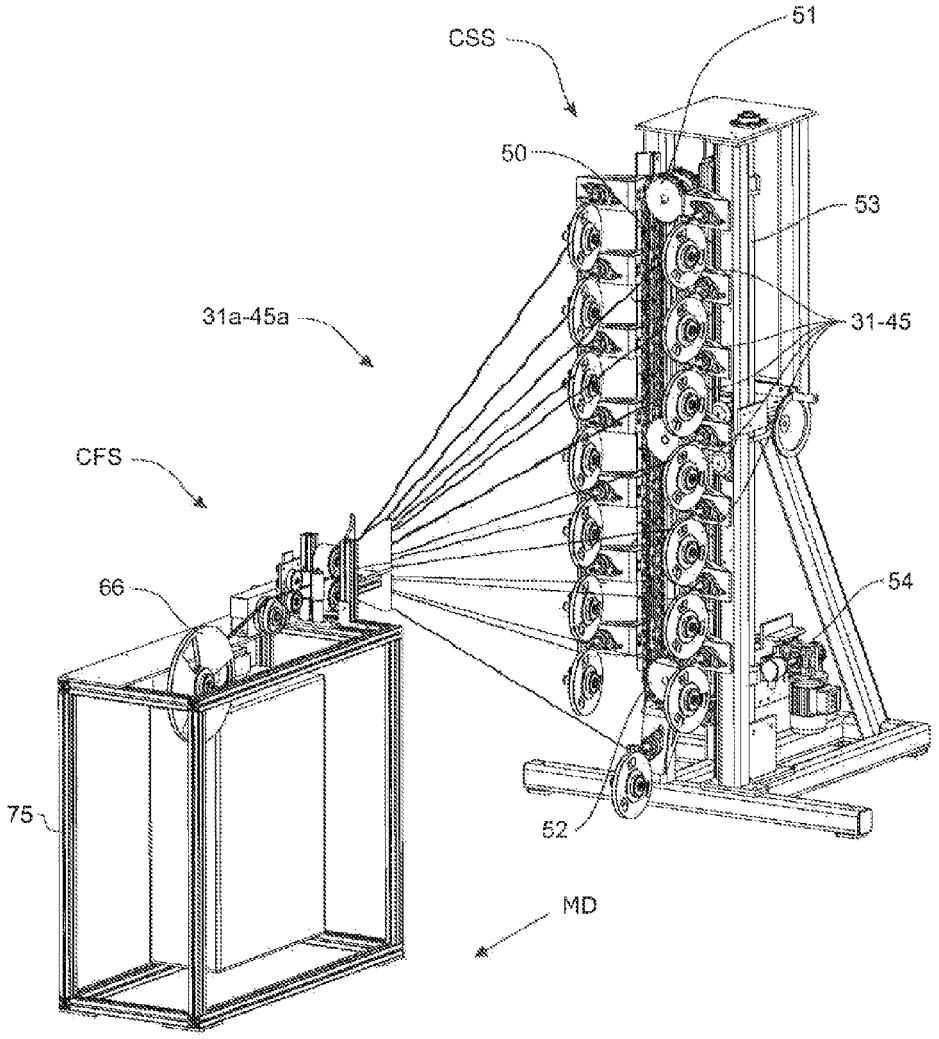
FIG. 5 is a perspective view of a cable winding machine of the invention, against the machine direction.
Figure 6:
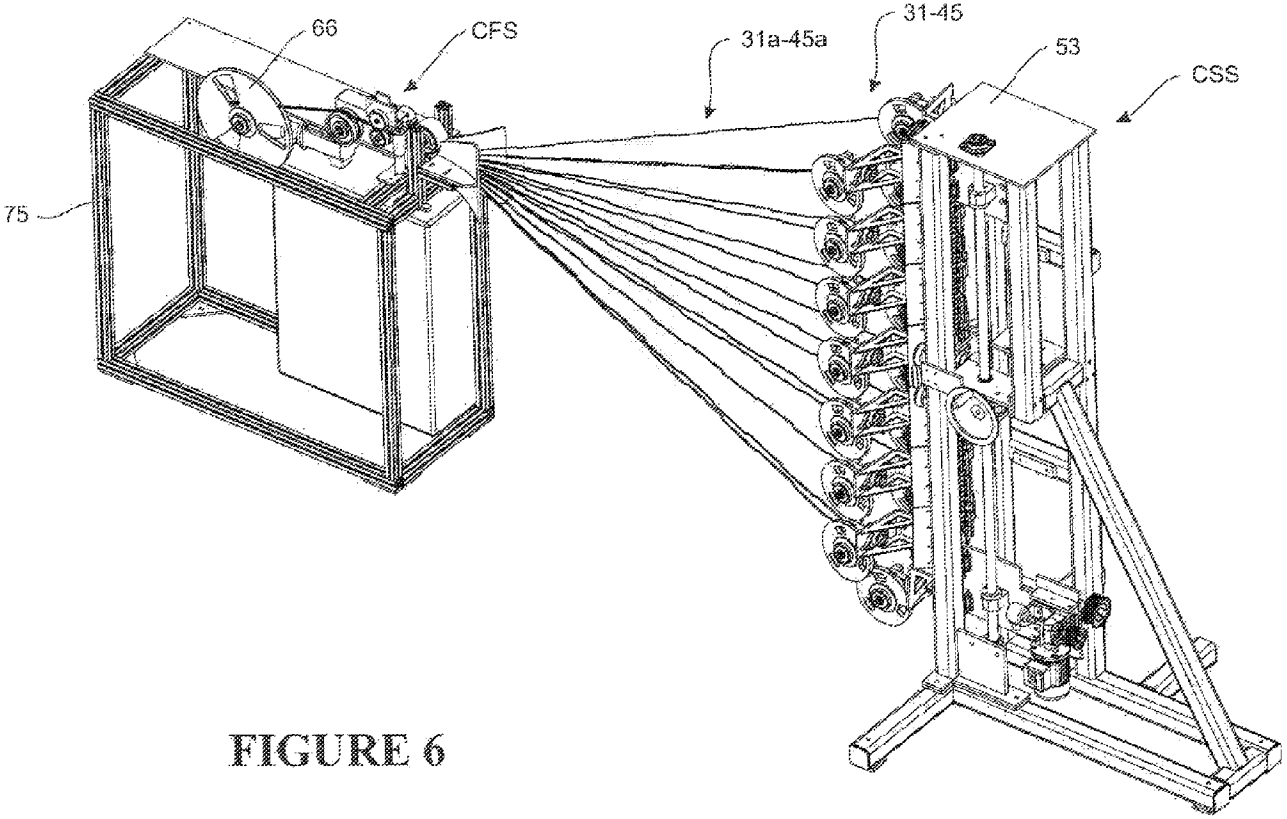
FIG. 6 is a perspective view of the cable winding machine of the invention, in the machine direction.
Figure 7:
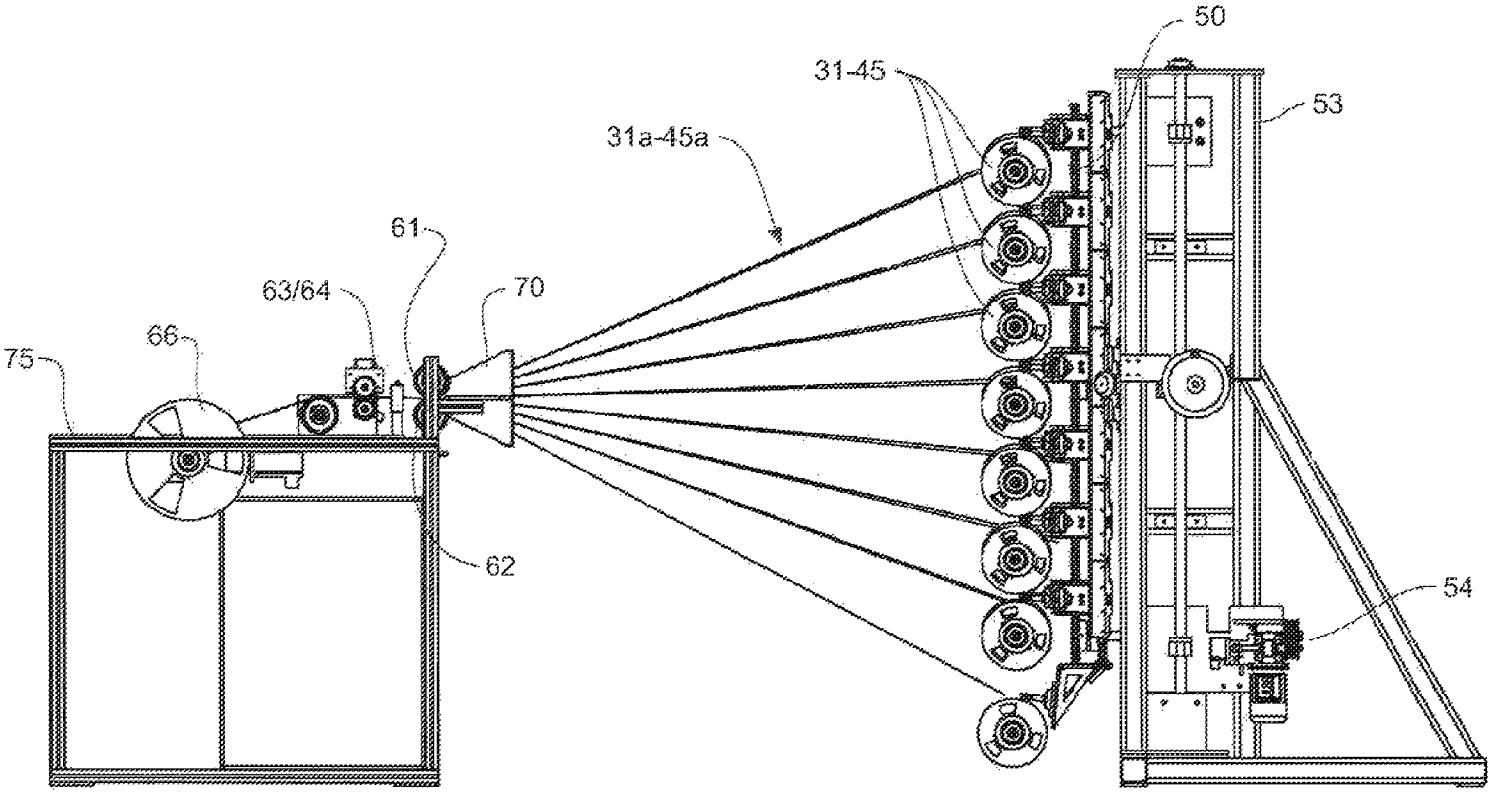
FIG. 7 is a side view of the machine of FIGS. 5 and 6.
Figure 8:
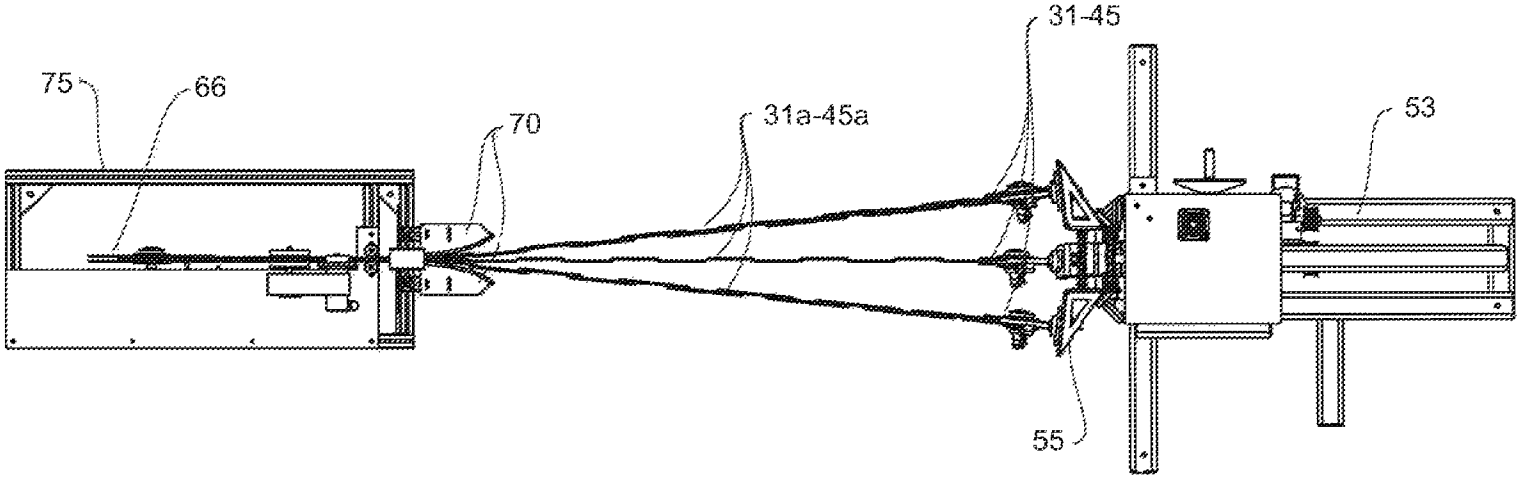
FIG. 8 is a plan view of the machine of FIGS. 5 and 6.

Serpentine subconductors of the type shown in FIG. 1 are unwound from the spools 31-45 with a longitudinal displacement between the subconductors 31*a*-45*a* of L/n where L is the subconductor transposition length and n is the total number of subconductors wound in the cable. Each subconductor is unwound from its supply spool and subsequently interleaves with the subconductor unwinding from the immediately prior spool on the spool conveyor 46 with a displacement of in the forward direction of −L/n, and with the subconductor unwinding from the next subsequent spool on the spool conveyor with a displacement of in the forward direction of L/n. FIG. 4 shows a time sequence, from 4A to 4D, illustrating interleaving of strands A, B, C, D, E, F, and G at the winding point. Because the spools 31-45 are maintained in a fixed orientation relative to ground and relative to one another as the spool conveyor 46 rotates, the subconductors 31*a*-45*a* are all held in a predetermined orientation relative to one another about their longitudinal axes as they move through the machine i.e. so as not to rotate or twist minimally relative to ground about their longitudinal axes. As stated the subconductors may be in tape form, and the spools 31-45 may unwind the tape subconductors with the width dimension of the subconductors parallel, which is maintained as the subconductors move through the machine. Where the subconductors comprise an HTS layer on serpentine substrate this will avoid bending and potentially damaging the HTS layer as the subconductors are wound into a composite cable.

A cable of as many subconductors as required can be wound by increasing the number of subconductor supply spools on the spool conveyor, and thus subconductors that are wound together at the winding stage. In the preferred embodiment the supply spools are placed equidistantly on the conveyor.

FIGS. 5-12 show a preferred embodiment cable winding machine in detail, similar to that described above with reference to FIG. 3. Many reference numerals in FIGS. 5-10 indicate similar elements as in FIG. 3. Referring first to FIGS. 5 to 8, the machine comprises conductor supply stage CSS and cable forming stage generally indicated at CFS arranged to bring together and interleave the subconductors to form the transposed cable. The spool conveyor comprises an endless chain conveyor which carries a subconductor unwind spool for each subconductor namely subconductor unwind spools 31-45. The spool conveyor chain 50 extends around upper and lower sprockets 51 and 52 each mounted to rotate about an axis parallel with the machine axis, at the top and bottom of frame 53 of the conductor supply stage CSS. The conductor supply stage CSS also comprises an electric motor drive system 54 to drive one or both of the sprockets 51 and 52. The drive to the spool conveyor, and thus movement of chain 50 and supply spools, is continuous and in operation all the subconductors are drawn continuously through the machine, to the cable forming stage CFS.

Figure 9:
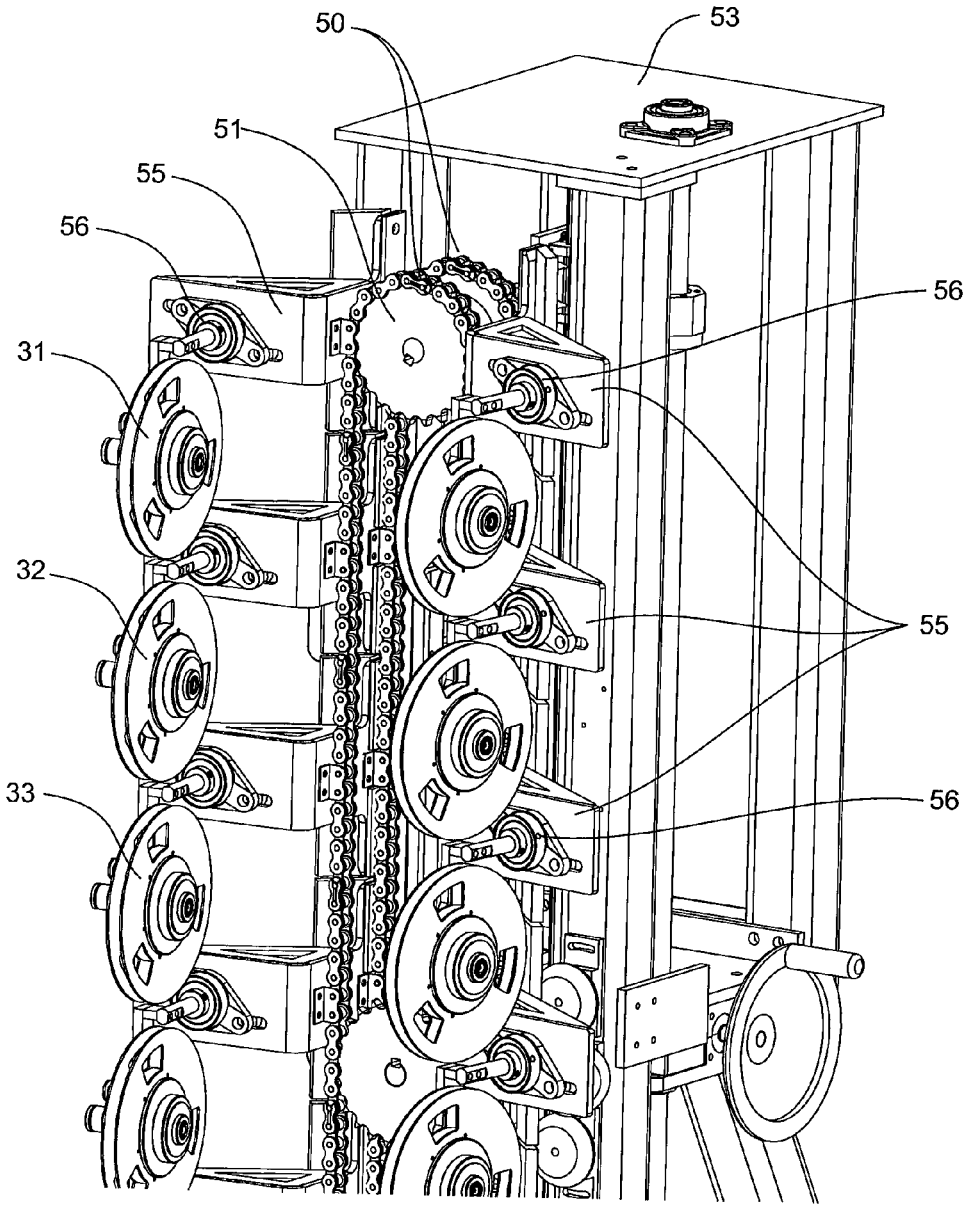
FIG. 9 is a close up perspective view of a conductor supply stage of the machine.

Referring particularly to FIG. 9, each supply spool 31-45 is carried by the spool chain 50 via a bracket 55 fixed to the chain 50. All of the brackets 55 are equidistantly spaced from each other on the chain 50. The spacing between the supply spools is such that only one spool at a time transitions across the top and bottom sprocket. Each spool 31-45 is mounted on its bracket 55 for rotation about an axis transverse to the machine axis, so that the subconductors 31*a*-45*a* are drawn from the supply spools in the machine direction (and converge towards the machine axis). Each supply spool 31-45 is also mounted to its bracket 55 so that it can pivot about an axis parallel to the machine axis. In the embodiment shown, a mounting for each supply spool 31-45 includes a journal or bearing 56 in its bracket 55. Each spool is arranged to be positioned with its axis of rotation horizontal as the spool both rises on one side of the conductor supply stage CSS, and descends on the other side, and as each spool passes about sprocket 51 at the top of the conveyor run and about sprocket 52 at the bottom of the conveyor run it is caused to pivot through 180 degrees smoothly and continuously in relation to the chain as the spool conveyor changes direction, so that the orientation of the subconductor unwound from that spool remains constant (in relation to other subconductors and the finished cable) as the spool moves on the spool conveyor. In the embodiment shown the supply spool is hung from a pivot point which is directly above the spool's centre-of-mass, so that the spool always hangs beneath the pivot. Specifically, each supply spool on the right hand side of in FIG. 9 of the conveyor run when next passing about top sprocket 51 pivots through 180 degrees with respect to the chain as it does so, so that the orientation of the spool is the same as it then descends the conveyor run on the left side of FIG. 1, and then pivots in a reverse direction back through 180 degrees as the supply spool passes around bottom sprocket 52 (in an alternative embodiment the spool conveyor may operate in the opposite direction). Thus the orientation of the subconductors 31*a*-45*a* is maintained as they are unwound so that they twist minimally about their length during cable forming, and so that the orientation of each of the subconductors is constant relative to one another. Thus as subconductors move forward through the machine they are rotated or orbited about the machine axis while minimally themselves rotating or twisting about their longitudinal axes. At machine setup for a production run of cable, the spool conveyor and each supply spool is indexed so that each subconductor unwinds correctly relative to adjacent subconductors, as described previously.

As each supply spool moves on the spool conveyor the distance between the supply spool and the cable forming stage CFS varies, and in particular is at its greatest when the supply spool is at the top or bottom of the conveyor run and at its least when the supply spool is midway of the conveyor run on either side. It is important to maintain substantially constant and similar tension in the subconductor length or span between each of the spools and the cable forming stage whatever the position of the spool on the spool conveyor and thus a back winding mechanism is provided which maintains tension by rewinding excess subconductor length back onto the supply spools as they move from the top or bottom of the conveyor run towards the centre of the conveyor run on either side, and increases or allows to increase the unwind speed of the supply spools as they move from the centre of the conveyor run on either side towards the top or bottom of the conveyor run. A back wind mechanism may comprise a spring with a tensioning clutch, which applies torque against unwinding of the supply spools so as to take up slack and set a constant de-spool tension in the subconductors, or alternatively an electrically driven back winding motion coupled to a tensioning clutch, at each supply spool 31-45.

Figure 10:
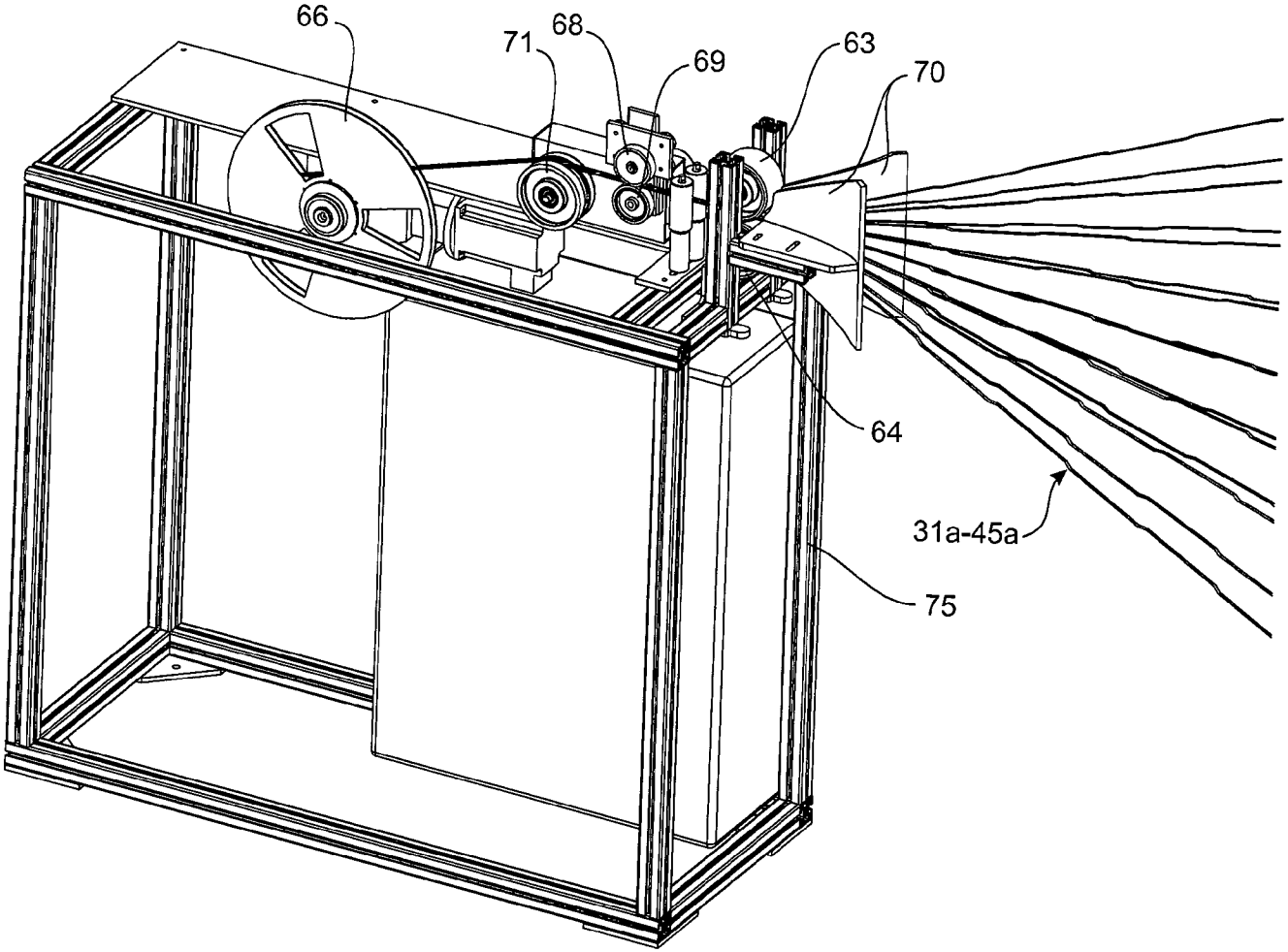
FIG. 10 is a side view of a cable forming stage of the machine.
Figure 11:
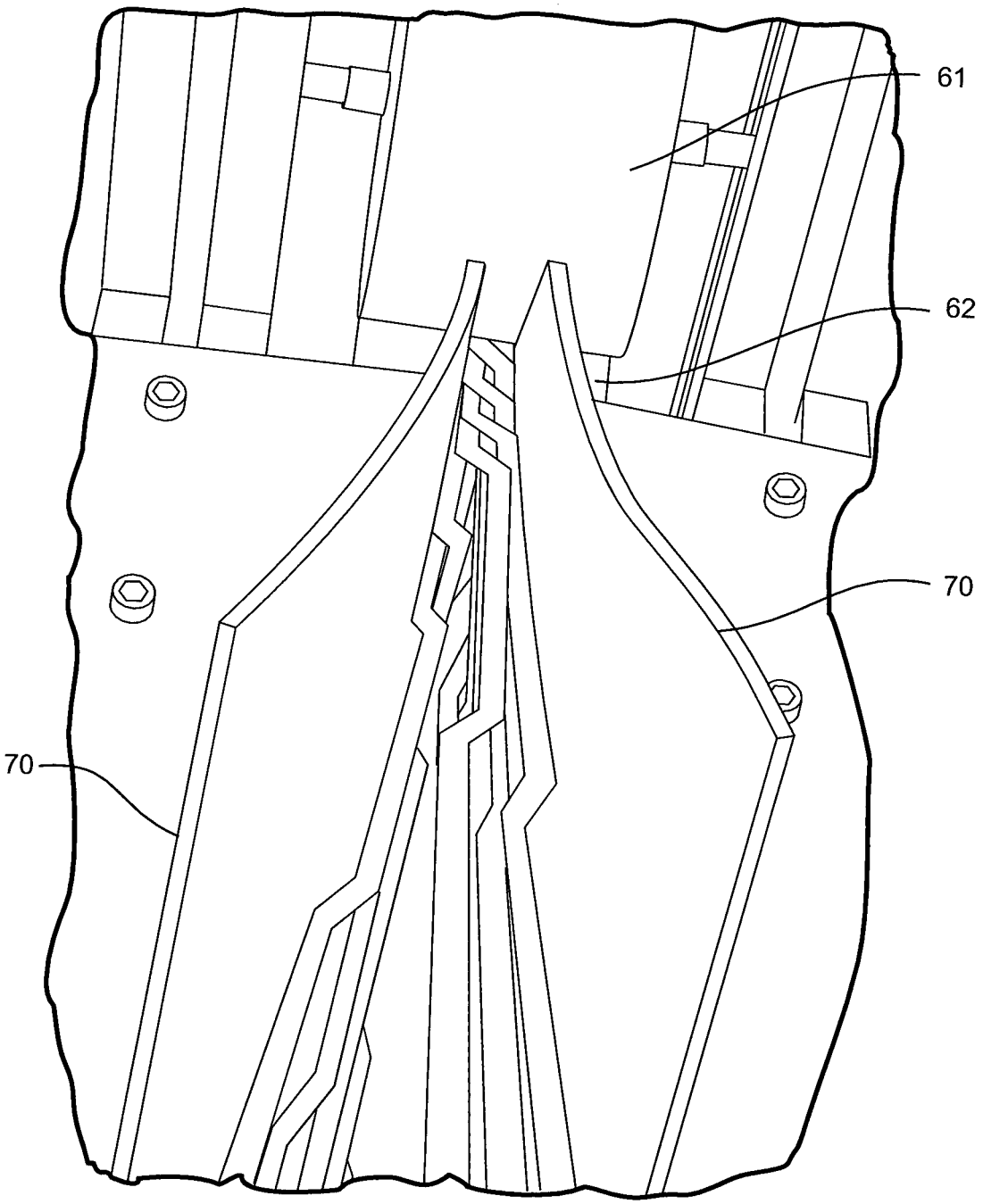
FIG. 11 is a perspective view in the machine direction into the cable forming stage of the machine.
Figure 12:
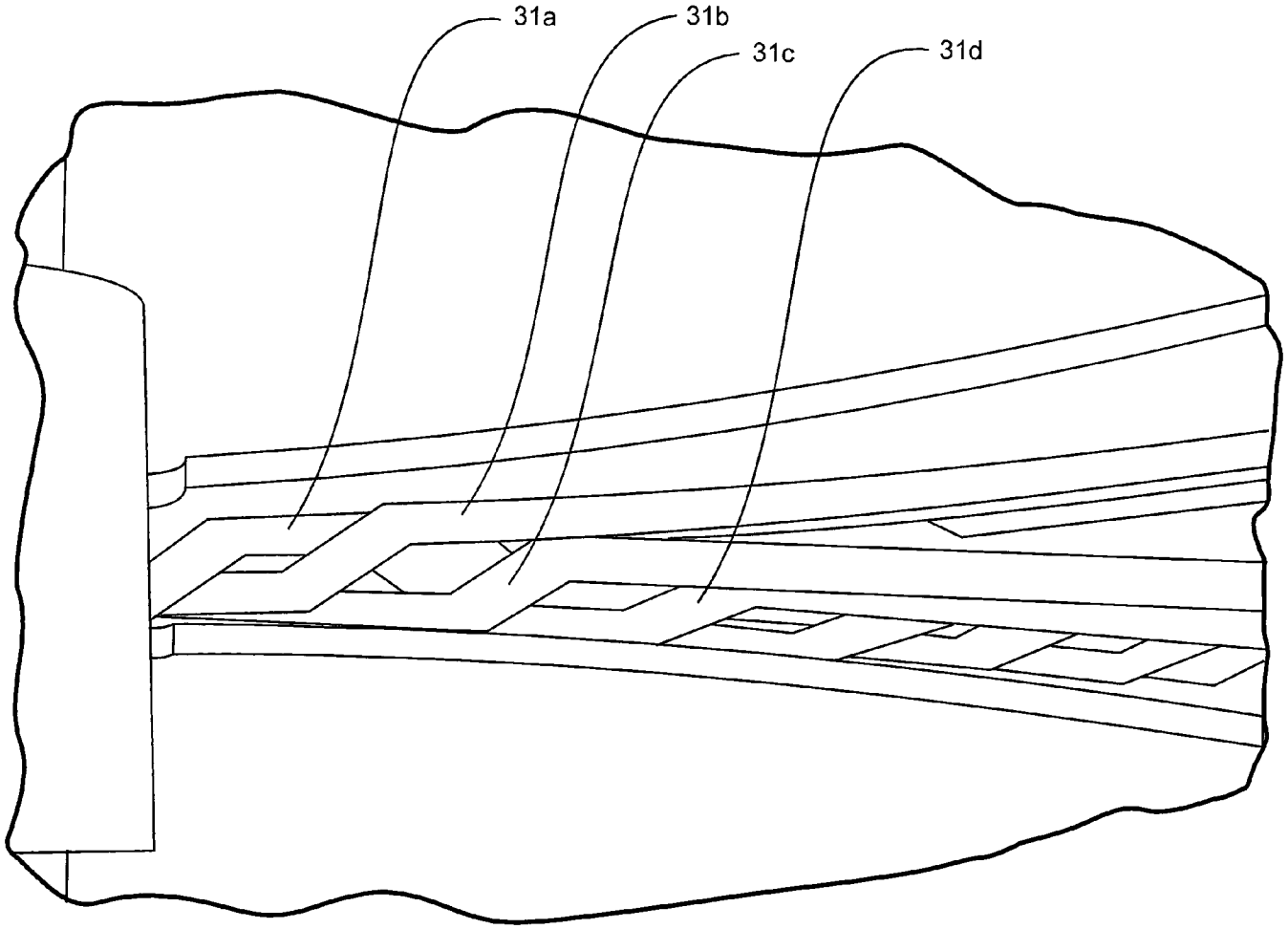
FIG. 12 is a plan view of entry into the cable forming stage of the machine.

FIG. 10 shows the cable forming stage CFS from one side, FIG. 11 is a view looking into the cable forming stage in the machine direction, and FIG. 12 is a plan view of the entry into the cable forming stage. The cable forming stage comprises spaced guides 70 on either side of the machine axis, and then a first two opposed rollers 61 and 62 mounted about spaced horizontal axes across and on either side of the machine axis, followed by two opposed rollers 63 and 64 mounted about spaced vertical axes on either side of the machine axis, as shown. The subconductors 31*a*-45*a* are drawn from the supply spools 31-45 and between the entry guides 70 are continuously brought together into a stack of a type shown in FIG. 2A as described further below, and then pass between rollers 61 and 62 and rollers 63 and 64. During machine operation the movement of the supply spools about the spool conveyor as described ensures that the subconductors are all orbiting about the machine axis before and as the subconductors enter the guides 70, and this causes transposition of the subconductors about the machine axis and relative to one another to simultaneously and continuously as the subconductors are interleaved together to form the cable between the guides 70 and as the subconductors enter the rollers 61 and 62. FIGS. 11 and 12 show subconductors passing between the guides 70. The guides 70 define a tapering passage of decreasing width, which gradually brings the subconductors together. As stated because of the lengthwise phasing of the subconductors relative to one another as they are unwound, when they are brought together in the cable forming stage they interleave correctly to form the transposed cable. In FIG. 12 individual subconductors are indicated at 31*a*-31*d* by way of example. Because the subconductors are orbiting about the machine axis as they pass between the guides 70, they will move up—on one side—and down—on the other side—relative to and against the inside faces of guides 70.

In the preferred form, the transposed cable exiting the cable forming stage passes between rollers 68 and 69, which are electronically monitored to measure the length of subconductors drawn from the supply spools and through the cable forming stage CFS. The formed cable then passes from the nip rollers over guide roller 71 and to take up spool 66 which is driven by an electric motor that is controlled by an electronic microprocessor to ensure that cable is drawn from the machine at a rate which matches the orbital rate of supply spools held upon the conductor supply stage CSS as previously described.

The take up spool 66 and cable forming stage CFS are mounted on a frame 75 which positions in particular the cable forming stage CFS in the machine axis as referred to previously.

A microprocessor based machine controller controls drive to an electric motor of the conductor supply stage CSS, and measures the rotation of nip rollers 68 and 69 to provide feed-back control of an electric motor which rotates the take up spool 66.

In the preferred form shown the spool conveyor 46 is a chain conveyor but alternatively may comprise for example an industrial grade belt conveyor, carrying suitable mountings for the supply spools. The spool conveyor follows a path between two vertically spaced sprockets 51 and 52 but alternatively may follow a path between two horizontally spaced sprockets or similar.

An advantage of the machine of the invention is that the number of subconductors from which a cable is formed can be varied relatively easy to form cables of different size or capacity, by varying the number of supply spools carried by the spool conveyor. For example one or both of the sprockets 51 and 52 may be mounted to be movable vertically enabling the length of the spool conveyor run to be increased or reduced, and one or more unit lengths of chain each carrying a bracket 55 or equivalent and supply spool may be added to or removed from the spool conveyor chain 50 to increase or decrease the number of subconductors wound into a cable.

Preferred forms of the machine are designed for winding Roebel cable from subconductors having a serpentine shape, and in which each subconductor is an HTS subconductor comprising a layer of an HTS compound thereon, but in alternative embodiments the machine may be arranged to wind cable from serpentine non-HTS conductors such as serpentine copper conductors for example.

The foregoing describes the invention including a preferred form thereof. Alterations and modifications as will be obvious to those skilled in the art are intended to be incorporated within the scope hereof as defined in the accompanying claims.

The invention claimed is:

1. A cable winding machine for winding transposed cable from multiple serpentine subconductors, comprising:

a conductor supply stage carrying a subconductor supply spool for each subconductor and arranged to move the supply spools about a machine axis and maintain the supply spools in a common orientation as the multiple serpentine subconductors unwind from the supply spools and move through the machine in a machine direction, a cable forming stage after the conductor supply stage in the machine direction, arranged to bring together the subconductors and at which the subconductors interleave to form the transposed cable, and wherein each subconductor supply spool comprises an associated back-wind mechanism arranged to pay out the subconductor at a substantially constant tension and also rewind excess subconductor length back onto the spool when required during operation of the conductor supply stage.

2. A machine according to claim 1 wherein the conductor supply stage is arranged to move the subconductors in a non-circular path about the machine axis.

3. A machine according to claim 1 wherein the conductor supply stage comprises an endless conveyor.

4. A machine according to claim 1 wherein the cable forming stage comprises guides on either side of the machine axis between which all of the subconductors are continuously brought together.

5. A machine according to claim 4 wherein the cable forming stage comprises after said guides, opposed rollers about spaced axes across and on either side of the machine axis, followed by opposed rollers about oppositely-oriented axes again spaced on either side of the machine axis.

6. A machine according to claim 1 wherein the subconductors move through the machine with a longitudinal displacement between subconductors of L/n where L is a subconductor transposition length and n is the total number of subconductors wound in the cable.

7. A cable winding machine for winding transposed cable from multiple serpentine subconductors, comprising:

a conductor supply stage comprising an endless flexible conveyor carrying a subconductor unwind spool for each subconductor and arranged to move the unwind spools about a machine axis and maintain the unwind spools in a predetermined orientation and at a substantially constant tension as the multiple serpentine subconductors unwind from the spools and move through the machine in a machine direction, and a winding stage after the conductor supply stage in the machine direction, arranged to bring together the subconductors and at which the subconductors interleave to form the transposed cable.

8. A machine according to claim 7 wherein the conductor supply stage is arranged to move the subconductors in a non-circular path about the machine axis.

9. A machine according to claim 7 wherein the conductor supply stage comprises a chain or belt-based conveyor.

10. A machine according to claim 7 wherein the conveyor carries a subconductor supply spool for each subconductor.

11. A machine according to claim 7 wherein each subconductor supply spool comprises an associated back-wind mechanism arranged to pay out the subconductor at a substantially constant tension and also rewind excess subconductor length back onto the spool when required during operation of the conductor supply stage.

12. A machine according to claim 7 wherein the subconductors move through the machine with a longitudinal displacement between subconductors of L/n where L is a subconductor transposition length and n is the total number of subconductors wound in the cable.

13. A machine according to claim 7 wherein the cable forming stage comprises guides on either side of the machine axis between which all of the subconductors are continuously brought together.

14. A machine according to claim 13 wherein the cable forming stage comprises after said guides, opposed rollers about spaced axes across and on either side of the machine axis, followed by opposed rollers about oppositely-oriented axes again spaced on either side of the machine axis.

15. A machine according to claim 1 wherein the subconductors each have a width dimension across a longitudinal axis greater than a depth dimension through the longitudinal axis perpendicular to the width direction and the machine is arranged to hold the subconductors with the width dimension of the subconductors parallel as the subconductors move through the machine.

16. A machine according to claim 15 wherein the subconductors are HTS subconductors.

17. A machine according to claim 16 wherein the subconductors comprise flat tapes comprising an HTS layer.

18. A machine according to claim 7 wherein the subconductors each have a width dimension across a longitudinal axis greater than a depth dimension through the longitudinal axis perpendicular to the width direction and the machine is arranged to hold the subconductors with the width dimension of the subconductors parallel as the subconductors move through the machine.

19. A machine according to claim 18 wherein the subconductors are HTS subconductors.

20. A machine according to claim 19 wherein the subconductors comprise flat tapes comprising an HTS layer.

21. A cable winding machine for winding transposed cable from multiple serpentine subconductors, comprising:

a conductor supply stage comprising an endless flexible conveyor carrying multiple subconductor unwind spools carrying subconductors comprising flat serpentine tapes comprising an HTS layer, the conductor supply stage arranged to move the unwind spools about a machine axis and maintain the unwind spools in a predetermined orientation and at a substantially constant tension as the multiple serpentine subconductors unwind from the spools and move through the machine in a machine direction, the conveyor carrying associated back-wind mechanisms arranged to rewind excess subconductor length back onto the spools when required during operation of the conductor supply stage, as the subconductors move through the machine with a longitudinal displacement between subconductors of L/n where L is a subconductor transposition length and n is the total number of subconductors wound in the cable, and a winding stage after the conductor supply stage in the machine direction, arranged to bring together the subconductors and at which the subconductors interleave to form the transposed cable.

* * * * *